United States Patent [19]

Ritten

[11] Patent Number: 4,724,925

[45] Date of Patent: Feb. 16, 1988

[54] BOAT BOARDING LADDERS

[75] Inventor: Robert G. Ritten, Ft. Pierce, Fla.

[73] Assignee: Step-On Inc., Ft. Pierce, Fla.

[21] Appl. No.: 48,543

[22] Filed: May 11, 1987

[51] Int. Cl.[4] ..... B63B 29/20; E06C 5/04

[52] U.S. Cl. ..... 182/97; 182/86; 182/194; 182/206; 114/362; 280/166

[58] Field of Search ..... 182/97, 206, 178, 91, 182/87, 150, 151, 228, 93, 86, 1; 280/166; 114/362

[56] References Cited

U.S. PATENT DOCUMENTS

| | | | |
|---|---|---|---|
| 2,755,981 | 7/1956 | Edwards | 182/228 |
| 3,307,654 | 3/1967 | Green | 182/206 |
| 3,390,740 | 7/1968 | Brandel | 182/93 |
| 3,512,608 | 5/1970 | Huntley | 182/206 |
| 3,774,720 | 11/1973 | Hovey | 182/88 |
| 3,858,683 | 1/1975 | Rachocki | 182/206 |
| 3,973,646 | 8/1976 | Martinez | 182/97 |
| 3,991,851 | 11/1976 | Gannon | 182/228 |
| 4,002,223 | 1/1977 | Bernkrant | 182/206 |
| 4,086,980 | 5/1978 | Shortes | 182/151 |
| 4,462,485 | 7/1984 | Terry | 182/91 |

*Primary Examiner*—Reinaldo P. Machado
*Attorney, Agent, or Firm*—Carroll F. Palmer

[57] ABSTRACT

A boarding ladder which may be mounted on a topsides surface of a boat to be swingable between a raised position where all parts of the ladder are above the waterline of the boat and a lowered position where at least one step of the ladder extends below the waterline is formed of a step unit and a mount unit. The step unit has a pair of spaced apart tubular siderails carrying flat tread steps so as to permit the angle of their flat treads to be varied relative to the siderails. A tubular cross member extends across the top ends of the siderails. The mount unit has a pair of spaced apart, tubular sections rotatably carried on the cross member of the ladder unit and which extend normally thereof. Mounting members into which such tubular sections fit permit the ladders to be mounted on the topsides surface of a boat while supporting the ladder in a proper operating posture.

13 Claims, 10 Drawing Figures

BOAT BOARDING LADDERS

BACKGROUND OF THE INVENTION

1. Field of the Invention

This invention relates to boarding ladders for boats. More particularly, it concerns such ladders designed primarily to be permanently mounted on pleasure boats, e.g., sailboats, sportfishing boats, etc., to swing from a raised, storage position clear of the water to a lowered, use position in which at least one step thereof is immersed in the water.

2. Description of the Prior Art

Boarding ladders for pleasure boats, as opposed to those intended for use on freighters and other large vessels, can be divided into two broad classes, namely, those that are carried on mounts permanently attached to the boat and those that mount temporarily on the boat only during use. This invention relates to the permanently attached type.

Some ladders of the permanent type are attached to platforms that extend from the boat, generally aft of the stern, e.g., see U.S. Pat. No. 4,462,485 and co-pending U.S. patent application Ser. No. 901,268, filed Aug. 29, 1986. Others of the permanent type are designed to be attached directly to the topsides per se of the boat, e.g., see U.S. Pat. No. 3,774,720 and co-pending U.S. patent application Ser. No. 917,801, filed Oct. 10, 1986. This invention relates to boat ladders of the latter type.

A favorite location for mounting a boarding ladder of the permanently attached type to a boat is at the stern. This avoids possible contact of the ladder with pilings, etc. in entering or leaving a berth. Also, this presents best access to the ladder in rear cockpit boats, such as sailboats and sportfishers. However, since many of the transoms of boats, particularly sailboats, extend, not normal to the waterline of the boat, but at an acute angle thereto, many of the boarding ladders of the permanent type available heretofore are difficult or impossible to be mounted on the angles transoms for support in an acceptable operating posture. In contrast, this invention provides boarding ladders that may be mounted on a sloped topsides surface of a boat, e.g., the reverse transom of a sailboat, and be supported in a proper operating posture.

OBJECTS

A principal object of the invention the provision of improved forms of boarding ladders for boats of the permanently attached class.

Further objects include the provision of:

1. New forms of boarding ladders to be permanently mounted on pleasure boats, e.g., sailboats, sportfishing boats, etc., to swing from a raised, storage position clear of the water to a lowered, use position in which at least one step thereof is immersed in the water.

2. Such ladders in which the steps have flat tread portion, in contrast to tubular or narrow rungs, the angle of which may be changed so as to accommodate the ladder to varied transom angles.

3. Such ladders assembled from basic structural members so that ladders of different lengths and other variations may be created from a minimum of different type parts thereby reducing manufacturing inventories of parts.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of boarding ladder that may be mounted on a topsides surface of a boat to be swingable between a raised position where all parts of the ladder are above the waterline of the boat and a lowered position where at least one step of the ladder extends below the waterline which basically comprise a step unit and a mount unit.

In a first embodiment, the step unit includes a pair of spaced apart, first and second tubular siderails each having an upper end, a lower end and a central portion joining the upper end to the lower end, a flat tread top step carried on the upper end by means permitting the angle of the flat tread to be varied relative to the siderails, a flat tread bottom step carried on the lower end by means permitting the angle of the flat tread to be varied relative to the siderails, and a plurality of flat tread intermediate steps carried on the central portion by means permitting the angle of the flat tread to be varied relative to the siderails.

The siderails extend longitudinally beyond the top step terminating in a first siderail top end and a second siderail top end and a tubular cross member extends between and is connected to the first and second siderail top ends.

The mount unit includes a pair of spaced apart first T-members each comprising a tubular cross portion and a leg portion extending normally of the cross portion. The cross portions of the first T-members are rotatably carried on the cross member of the ladder unit and tubular sections extend axially from the leg portions of the first T-members. Mounting members comprising flat bases are carried by the ends of the tubular sections opposite the first T-members with the flat bases angled relative to the tubular sections that permit the ladders to be mounted on the sloped topsides surface of a boat while supporting the ladder in a proper operating posture.

In preferred embodiments of the invention, the first and second siderails are both formed of a plurality of short sections of metal tubing fixed together by T-joints. Also, the steps comprise a flat tread member fixed to a supporting section of tubing having a first end and a second end, the first end of each such section of tubing is carried in a T-joint of the first siderail and the second end of each such section of tubing is carried in a T-joint of the second siderail and the T-joints include set screws to enable the flat tread member of each the step to be held in at a fixed angle relative to the longitudinal axis of the siderails.

Further, the new ladders preferably include lateral members to hold the ladder spaced apart from the topsides surface when the ladder is in the lowered position, which lateral members may comprise second T-members having a tubular cross portion and a leg portion extending normally of the cross portion and the cross portions of such second T-members are rotatably carried on one of the short tubular sections of siderails and a section of metal tubing extends axially from the leg portions of the second T-members. Advantageously, the second T-members include set screws to enable the lateral members to be fixed normally of the longitudinal axis of the steps.

In some embodiments of the invention, the mount unit is structured to mount on a boat topsides surface that is sloped at an acute angle relative to the waterline of the boat with the tubular sections thereof fixed substantially parallel to the waterline of the boat and such mount unit may include a flat tread step fixed to the tubular sections.

In other embodiments, the mount unit is structured to mount on the topsides surface that is substantially parallel to the waterline of the boat and the tubular sections of the mount unit are arcuate permitting the mounting members to have their the flat bases fixed to the parallel topsides surface while supporting the ladder in a proper operating posture.

BRIEF DESCRIPTION OF THE DRAWINGS

A more complete understanding of the invention may be had by reference to the accompanying drawings in which.

DESCRIPTION OF THE PREFERRED EMBODIMENTS

Figure 10:
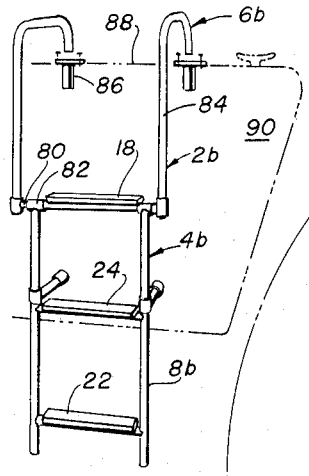
FIG. 10 is a plan view of another embodiment of a ladder of the invention.

Referring in detail to the drawings, in which identical parts are identically marked, the invention comprises a boat boarding ladder 2 comprising a step unit 4 and a mount unit 6.

The step unit 4 includes a first tubular siderail 8 and second tubular siderail 10 each having an upper end 12, a lower end 14 and a central portion 16 joining the upper end to the lower end, a flat tread top step 18 carried on the upper end 12 by means 20 permitting the angle of the flat tread step to be varied relative to the siderails. A flat tread bottom step 22 is similarly carried on the lower end 14 and at least one flat tread intermediate step 24 similarly carried on the central portion 16.

The siderails 8 and 10 extend longitudinally beyond the top step 18 to terminate in a first siderail top end 26 and a second siderail top end 28. A tubular cross member 30 extends between and is connected to the first and second siderail top ends 26 and 28 via the elbow joints 32.

There is a mount unit having a pair of spaced apart T-members 34 each comprising a tubular cross portion 36 and a leg portion 38. The cross portions 36 are rotatably carried on the cross member 30.

Tubular sections 40 extend axially from the leg portions 38 of the T-members 34 and mounting members 42 with flat bases 44 are carried by the ends of the tubular sections 40 with the flat buses 44 angled relative to the tubular sections 40 to permit the ladders to be mounted on the sloped topsides surface 46 of the boat 48 while supporting the ladder 2 in a proper operating posture.

As shown in FIGS. 2–5, mounting members 42 may be structured to accommodate various angles of slope in the topsides surface. Thus, the member 42*a* has a tube socket 46*a* with a 30° angle, member 42*b* has a tube socket 46*b* with a 45° angle, member 42*c* has a tube socket 46*c* with a 60° angle, member 42*d* has a tube socket 46*d* with a 90° angle.

The first and second siderails are both formed of a plurality of short sections 50 of metal tubing fixed together by T-joints 52.

The steps 18, 22 and 24 are all constructed with a flat tread member 54 fixed to a supporting section of tubing 56 having a first end 58 and a second end 60. The first end 58 of each section 56 of the top step 18 and intermediate steps 24 is carried in a T-joint 52 of the first siderail 8 and the second end 60 of each the respective section 56 is carried in a T-joint 52 of the second siderail 16. In the bottom step 22, the end 58 and 60 are carried in elbow joints 32 rather than T-joints.

To enable the flat tread member 54 of each the step to be held in at a fixed angle relative to the longitudinal axis of the siderails 8 and 10, there are set screws (not shown) provided in each of the T-joints 52 and elbow joints 32.

Figure 1:
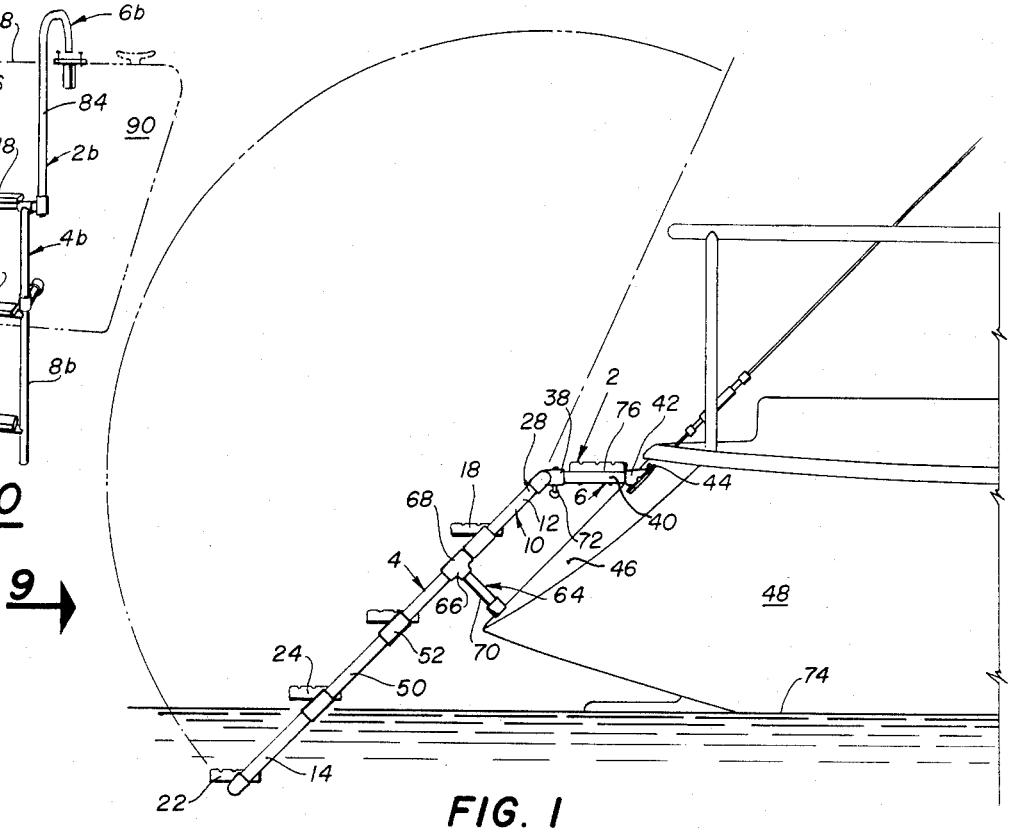
FIG. 1 is a fragmentary lateral view of the transom of a sailboat having a first embodiment of an improved boarding ladder of the invention permanently mounted thereon.
Figure 2:
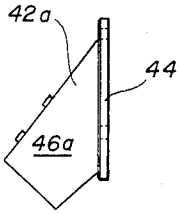
FIG. 2 is a lateral view a first embodiment of a ladder mounting member of the invention.
Figure 3:
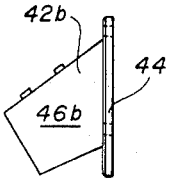
FIGS. 3–6 are lateral views of further embodiments of ladder mounting members of the invention.
Figure 4:
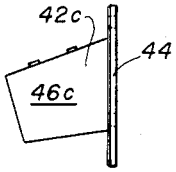
Figure 5:
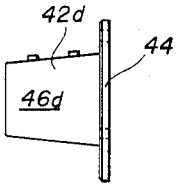

In order that the the ladder 2 may be held spaced apart from the topsides surface 46 when the ladder is in the lowered position as shown in FIG. 1, there are lateral members 64 that comprise second T-members 66 having cross portions 68 rotatably carried on one of the short tubular sections 50 of siderails 8 and 10 and a section 70 of metal tubing extends axially from the T-members 66.

Figure 7:
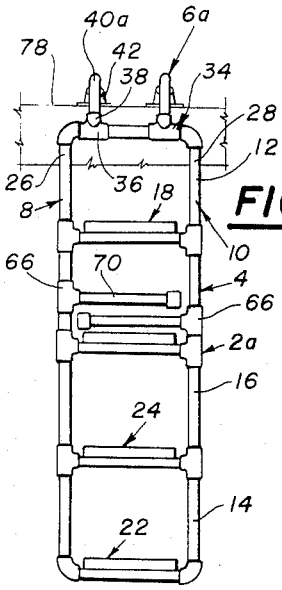
FIG. 7 is plan view of another embodiment of an improved boarding ladder of the invention.
Figure 8:
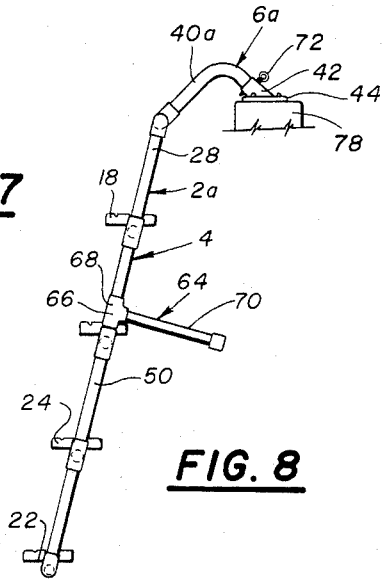
FIG. 8 is a lateral view of the ladder of FIG. 7.

The T-members 66 are provided with set screws (not shown) to permit the lateral members 64 to be fixed in the outstanding position (see FIG. 8) or in a folded position (see FIG. 7). The folded position is useful when the ladder 2 is in the raised position (dot-dash line FIG. 1) or the step unit 4 is removed from the mount unit 6 by removal of the fast-pin 72 which retains the tube sections 40 in the T-members 34.

Figure 9:
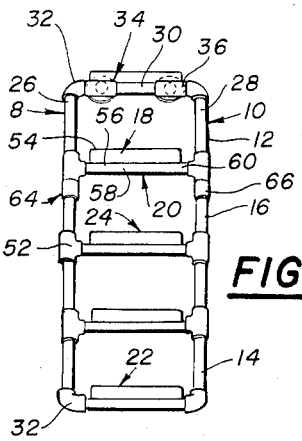
FIG. 9 is a plan view of the ladder of FIG. 1.

In the embodiment of FIGS. 1 and 9, the mount unit 6 is structured to mount on the topsides surface 46 that is sloped at an acute angle relative to the waterline 74 of the boat 48 with the tubular sections 40 thereof fixed substantially parallel to the waterline 74.

The mount unit 6 includes a flat tread step 76 fixed to the tubular sections 40.

The mount unit 6*a* of the ladder 2*a* is structured to mount on the topsides surface 78 that is substantially parallel to the waterline of the boat (not shown). The tubular sections 40*a* of such mount unit are arcuate permitting the mounting members 42 to have their the flat bases 44 fixed to the parallel topsides surface 78 while supporting the ladder 2*a* in a proper operating posture. In this mount unit 6*a*, the step unit 4 and part of the mount unit 6*a* may be removed for storage by pulling the fast-pins 72 that retain the tube sections 40*a* in the mount members 42.

In the embodiment of FIG. 10, the step unit 4*b* of the ladder 2*b* has a pair of spaced apart tubular siderails 8*b* carrying flat tread top step 18, bottom step 22 and middle step 24 so as to permit the angle of the flat tread to be varied relative to the siderails and a tubular cross member 80 extends across and is rotatably carried in the top ends 82 of the siderails 8*b*.

Figure 6:
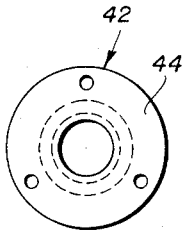

The mount unit *6b* has a pair of spaced apart, tubular sections 84 carried on the cross member 80 of the ladder unit and which extend normally thereof. Mounting members 86, generally similar in structure to the mounts shown in FIGS. 5 and 6, but installed up side down, into which such tubular sections 84 fit, permit the ladder *2b* to be mounted on the topsides surface 88 of the boat 90 while supporting the ladder *2b* in a proper operating posture.

The embodiments of the invention in which an exclusive property or privilege is claimed are defined as follows:

1. A boarding ladder which may be mounted on a topsides surface of a boat to be swingable between a raised position where all parts of the ladder are above the waterline of said boat and a lowered position where at least one step of the ladder extends below said waterline that comprises a step unit and a mount unit, said step unit comprising:

a pair of spaced apart, first and second tubular siderails each having an upper end, a lower end and a central portion joining said upper end to said lower end, a flat tread top step carried on said upper end by means permitting the angle of said flat tread to be varied relative to said siderails, a flat tread bottom step carried on said lower end by means permitting the angle of said flat tread to be varied relative to said siderails, at least one flat tread intermediate step carried on said central portion by means permitting the angle of said flat tread to be varied relative to said siderails, and a tubular cross member extending between and connected to said first and second siderail upper ends, said mount unit comprising:

a pair of spaced apart tubular sections extending normally from said cross member and mounting members comprising flat bases in which the ends of said tubular sections are carried to permit said ladder to be mounted on said topsides surface of a boat while supporting the ladder in a proper operating posture.

2. A boarding ladder which may be mounted on a topsides surface of a boat to be swingable between a raised position where all parts of the ladder are above the waterline of said boat and a lowered position where at least one step of the ladder extends below said waterline that comprises a step unit and a mount unit, said step unit comprising:

a pair of spaced apart, first and second tubular siderails each having an upper end, a lower end and a central portion joining said upper end to said lower end, a flat tread top step carried on said upper end by means permitting the angle of said flat tread to be varied relative to said siderails, a flat tread bottom step carried on said lower end by means permitting the angle of said flat tread to be varied relative to said siderails, a plurality of flat tread intermediate steps carried on said central portion by means permitting the angle of said flat tread to be varied relative to said siderails, said siderails extending longitudinally beyond said top step terminating in a first siderail top end and a second siderail top end, and a tubular cross member extending between and connected to said first and second siderail top ends.

3. The ladder of claim 2 wherein said mount unit comprises:

a pair of spaced apart first T-members each comprising a tubular cross portion and a leg portion extending normally of said cross portion, said cross portions of said first T-members being rotatably carried on said cross member of said ladder unit, tubular sections extending axially from said leg portions of said first T-members, and mounting members comprising flat bases carried by the ends of said tubular sections opposite said first T-members with said flat bases angled relative to said tubular, a pair of spaced apart tubular sections extending normally of said cross member, and mounting members comprising flat bases in which the ends of said tubular sections are carried opposite said first T-members with said flat bases angled relative to said tubular sections that permit said ladders to be mounted on said sloped topsides surface of a boat while supporting the ladder in a proper operating posture.

4. The ladder of claim 3 wherein said first and second siderails are both formed of a plurality of short sections of metal tubing fixed together by T-joints.

5. The ladder of claim 4 wherein said steps comprise a flat tread member fixed to a supporting section of tubing having a first end and a second end, said first end of each said section of tubing being carried in a T-joint of said first siderail and said second end of each said section of tubing being carried in a T-joint of said second siderail.

6. The ladder of claim 5 wherein said T-joints include set screws to enable said flat tread member of each said step to be held in at a fixed angle relative to the longitudinal axis of said siderails.

7. The ladder of claim 6 wherein said ladder includes lateral members to hold the ladder spaced apart from said topsides surface when said ladder is in said lowered position.

8. The ladder of claim 7 wherein said lateral members comprise second T-members comprising a tubular cross portion and a leg portion extending normally of said cross portion, said cross portions of said second T-members being rotatably carried on one of said short tubular sections of siderails and a section of metal tubing extends axially from said leg portions of said second T-members.

9. The ladder of claim 8 wherein said second T-members include set screws to enable said lateral members to be fixed normally of the longitudinal axis of said steps.

10. The ladder of claim 9 wherein said mount unit is structured to mount on said topsides surface that is sloped at an acute angle relative to said waterline of said boat with said tubular sections thereof fixed substantially parallel to said waterline of said boat.

11. The ladder of claim 10 wherein said mount unit includes a flat tread step fixed to said tubular sections.

12. The ladder of claim 11 wherein said mount unit is structured to mount on said topsides surface that is substantially parallel to said waterline of said boat.

13. The ladder of claim 12 wherein said tubular sections of said mount unit are arcuate permitting said mounting members to have their said flat bases fixed to said parallel topsides surface while supporting said ladder in a proper operating posture.

* * * * *